US006637844B1

(12) United States Patent
Luciano, Jr. et al.

(10) Patent No.: US 6,637,844 B1
(45) Date of Patent: Oct. 28, 2003

(54) GAMING CABINET FOOTRESTS

(75) Inventors: Robert Anthony Luciano, Jr., Reno, NV (US); Robert Steven Anderson, Reno, NV (US); Timothy Francis Kelley, Reno, NV (US); Russ Frederick Marsden, Reno, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/965,500

(22) Filed: Sep. 26, 2001

(51) Int. Cl.[7] ..... A63F 9/00
(52) U.S. Cl. ..... 312/223.1; 312/235.1
(58) Field of Search ..... 312/223.1, 223.2, 312/223.3, 7.2, 235.1, 235.9

(56) References Cited

U.S. PATENT DOCUMENTS 1,839,070 A * 12/1931 Wiener ..... 312/140.2
1,885,092 A * 10/1932 Fellerman ..... 312/140.1
1,944,405 A * 1/1934 Copeland ..... 312/140.2
D261,575 S 11/1981 Fear
D280,052 S 8/1985 Hypponen
4,920,458 A * 4/1990 Jones ..... 362/33
5,174,223 A * 12/1992 Nagy et al. ..... 108/50.01
D384,212 S 9/1997 Infanti
5,678,679 A 10/1997 Berman
5,826,882 A 10/1998 Ward
5,826,941 A * 10/1998 Olsen ..... 297/423.39
D416,054 S 11/1999 McGahn et al.
6,116,597 A 9/2000 Rowe et al.
6,422,670 B1 7/2002 Hedrick et al.

* cited by examiner

*Primary Examiner*—Janet M. Wilkens
(74) *Attorney, Agent, or Firm*—Russ F. Marsden

(57) ABSTRACT

A new player footrest is disclosed, usable as part of a gaming machine. The new footrest is mounted higher on the gaming cabinetry than was previously known in the art, providing a new and invigorating way to make significant changes to foot position, and therefore body position, during long game play periods. Further, in one embodiment the footrests are adjustable, providing even more player comfort and positional diversity.

4 Claims, 15 Drawing Sheets

Fixed, Stepped Base Cabinet Footrests

Adjustable Base Cabinet Footrests

Adjustable Base Cabinet Footrests

Adjustable Base Cabinet Footrest

Method For Retrofitting A Gaming Machine Or Base Cabinet With A Footrest

Method For Use Of Gaming Machine Or Base Cabinet With Footrests In Accordance With The Present Invention

GAMING CABINET FOOTRESTS

BACKGROUND OF THE INVENTION

1. Field of the Invention

This invention pertains generally to gaming machines. More particularly, the present invention relates to a method and apparatus for providing players using gaming machines more comfort through the incorporation of footrests that provide multiple sitting positions and allow placement at higher levels than currently available footrests.

2. The Prior Art

Las Vegas style casino environments having gaming machines where a player sits in front of a gaming machine to play are well known. Similar types of gaming machines with similar seating arrangements, from the perspective of the physical lay-out of the gaming cabinets, are also found in smaller gambling locations, including bingo halls and the like. Regardless of the establishment size or game types being played, the comfort issues facing a long-playing player are the same.

A long-playing player needs to move or adjust themselves as they continue to play. If a comfortable position cannot be found, the player will end play and move on. A significant part of a player's comfort, and the player's ability to shift positions in order to continue to play in comfort, is found in the location of a player's feet. If the footrest positions are different enough, shifting foot positions using different footrest positions will both cause and enable a player to shift their entire seating position, helping long-term comfort and play. Thus, the more footrest positions a player can make use, the longer a player can make use of a single machine.

Currently, footrests are provided in a few general implementations. The most common footrests are found as part of the chair in front of the gaming machine. One example is shown in U.S. Pat. No. D384,212, which shows a casino chair with a built-in solid-base footrest. Another common implementation uses footrails attached to the chair, the footrails usable as a footrest. One example of a footrail and chair assembly is shown in U.S. Pat. No. D261,575.

Typically, footrests are not part of the gaming machine itself. FIG. 1 shows a typical upright gaming machine, including a prior art base. A typical upright gaming machine includes an advertising or come-on section 100, a game display area 102, a pull handle 106, a player control area 104 typically populated with buttons but perhaps including other input devices, and a base cabinet 108. Base cabinet 108's primary purpose is to support the upright gaming machine at the desired height. Because gaming machines are typically arranged in casinos against a wall or back-to-back as well as side-to-side, base cabinets typically have solid backs and sides. Some base cabinets have solid fronts; some provide a hinged, lockable door as part of front panel 110. This space may be used by casino personnel for the storage of various maintenance items or player consumables (i.e., individually packaged hand wipes). In all cases, there is no place for a player's feet on the base cabinet. Examples of prior art game cabinets have solid front panels or a door are sold by Slot Machines USA, a company that makes base cabinets. Their address is: Slot Machines USA, 300 Gargrave Rd., West Carrollton, Ohio, 45449.

Prior art footrests not co-located with a chair are limited in location to the front of the gaming machine at or near floor level. These may be in the form of a footrail that is installed in front of several gaming machines (a bank of machines), or, occasionally, footrails attached to each gaming machine. An example of a footrail attached to an individual gaming machine is shown in FIG. 1 of U.S. Pat. No. 6,116,597.

An example of a board or flat surface used to replace a footrail is shown in FIG. 1 of U.S. Pat. No. D416,054. The flat board is designed to serve the same function as a footrail, only more cheaply. The player puts their feet up against the edge of the board, where the edge of the board then acts like the rail in a footrail.

Finally, one occasionally finds footrests similar to that shown in U.S. Pat. No. D280,052 placed in front of gaming machines for use by players.

These footrests all have similar drawbacks. Any footrest that is not part of a chair is placed in front of the gaming machine cabinet or base cabinet, at or near floor level, or occasionally mounted to a gaming machine at or near floor level. This provides limited foot placement options. As a result, players are confronted with a very limited set of options when playing at a gaming machine: use a footrest on or near the floor, or don't use one at all.

There is a need for footrests that provide more variability in location, including allowing additional height, than is currently known in the gaming machine furniture art. In addition, there is a need for additional footrests that are easy to install and maintain and do not add extra items to be moved by a floor cleaning crew.

BRIEF DESCRIPTION OF THE INVENTION

The present invention is a footrest assembly designed for use with gaming machines (installed on gaming machine cabinetry) that provides a neat appearance, enhanced foot placement choices, and especially provides alternative foot placement choices that are higher than are currently available. This is accomplished in several ways using different embodiments of the present invention. Further, the present invention provides for a variety of footrest assemblies that span a wide pricing range, allowing casinos the choice of upgrading using fairly inexpensive footrest assemblies that can retrofit existing gaming cabinetry, especially base cabinets, to further providing upscale and sophisticated multi-positional and adjustable footrest assemblies that can be used to either upgrade existing gaming cabinetry, or can be purchased built into new gaming cabinetry.

In a preferred embodiment, the disclosed footrest assemblies are designed to fit either at or near the top of a base cabinet and along its sides, or, along the sides of an existing gaming machine cabinet near the top of the lower cabinetry. The present invention may further replace an existing bolster unit.

Preferred embodiment fixed position footrest assemblies are set at or near the top of a base cabinet or near the top of the built-in lower cabinet of a single unit game machine cabinets, and are either a single unit or two individual units (other configurations may be used). The foot resting areas are part of a molding that is either substantially half-round in shape and construction, with the footrest area on the upper portions of the half-round, or are wedge-shaped, with the footrest area being a substantially flat section of the wedge.

Preferred embodiments also include multi-positional fixed position footrests, where a series of moldings similar to the individual moldings are supplied, and adjustable footrest assemblies, where the position of an individual footrest may be adjusted by a player.

The footrest assemblies of the present invention further allows the use of standard floor cleaning equipment up the bottom of the gaming cabinetry, decreasing special cleaning tasks and promoting general cleanliness when compared to separate footrests, or footrests that attached to furniture but that intrudes substantially into the space in front of the door or cabinet where it is used.

DETAILED DESCRIPTION OF PREFERRED EMBODIMENTS

Figure 1:
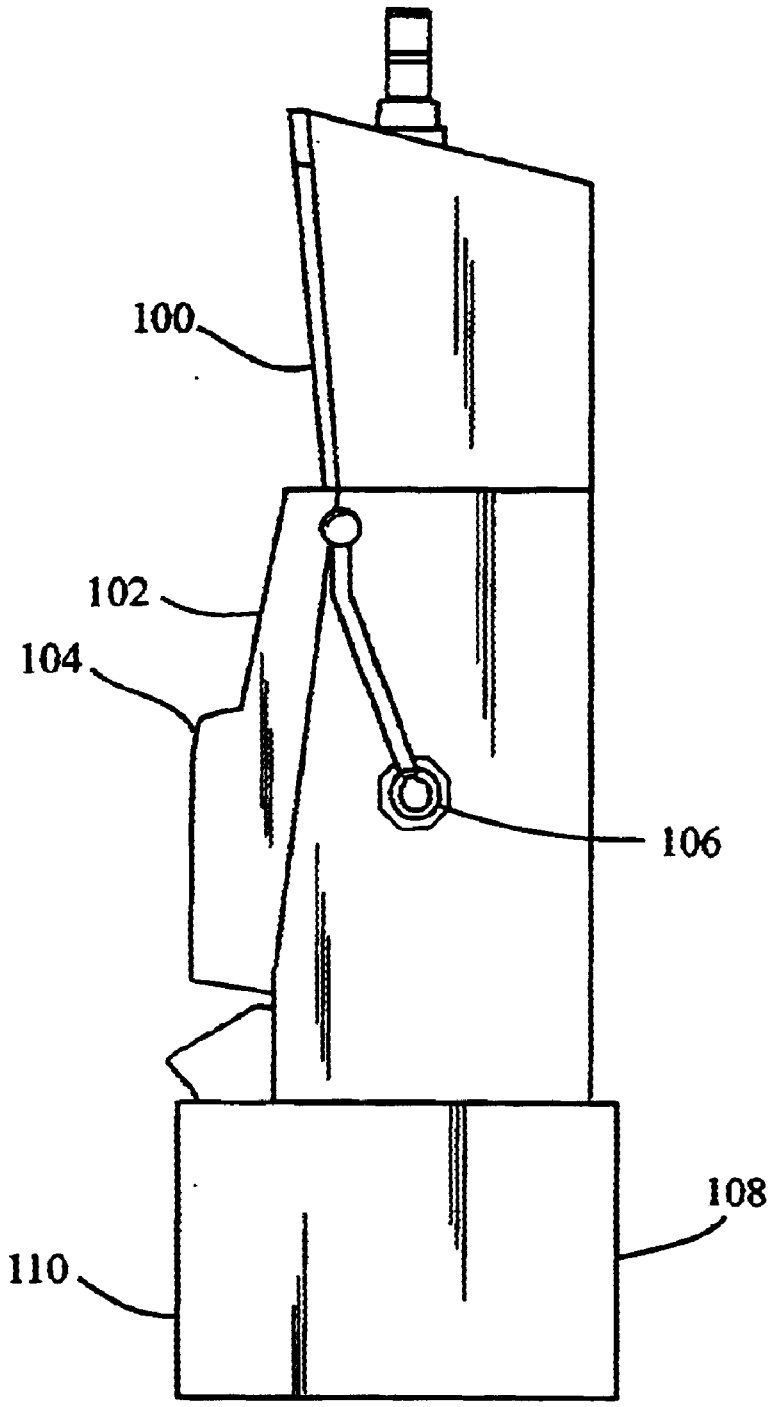
FIG. 1 is a side view of an upright gaming machine including a base as in the prior art.

Persons of ordinary skill in the art will realize that the following description of the present invention is illustrative only and not in any way limiting. Other embodiments of the invention will readily suggest themselves to such skilled persons having the benefit of this disclosure.

Referring to the drawings, for illustrative purposes the present invention is shown embodied in FIGS. 1 through 15. It will be appreciated that the apparatus may vary as to configuration and as to details of the parts without departing from the inventive concepts disclosed herein. The methods may vary as to details, partitioning, steps, repetition, and the order of the acts, without departing from the inventive concepts disclosed herein.

Figure 2:
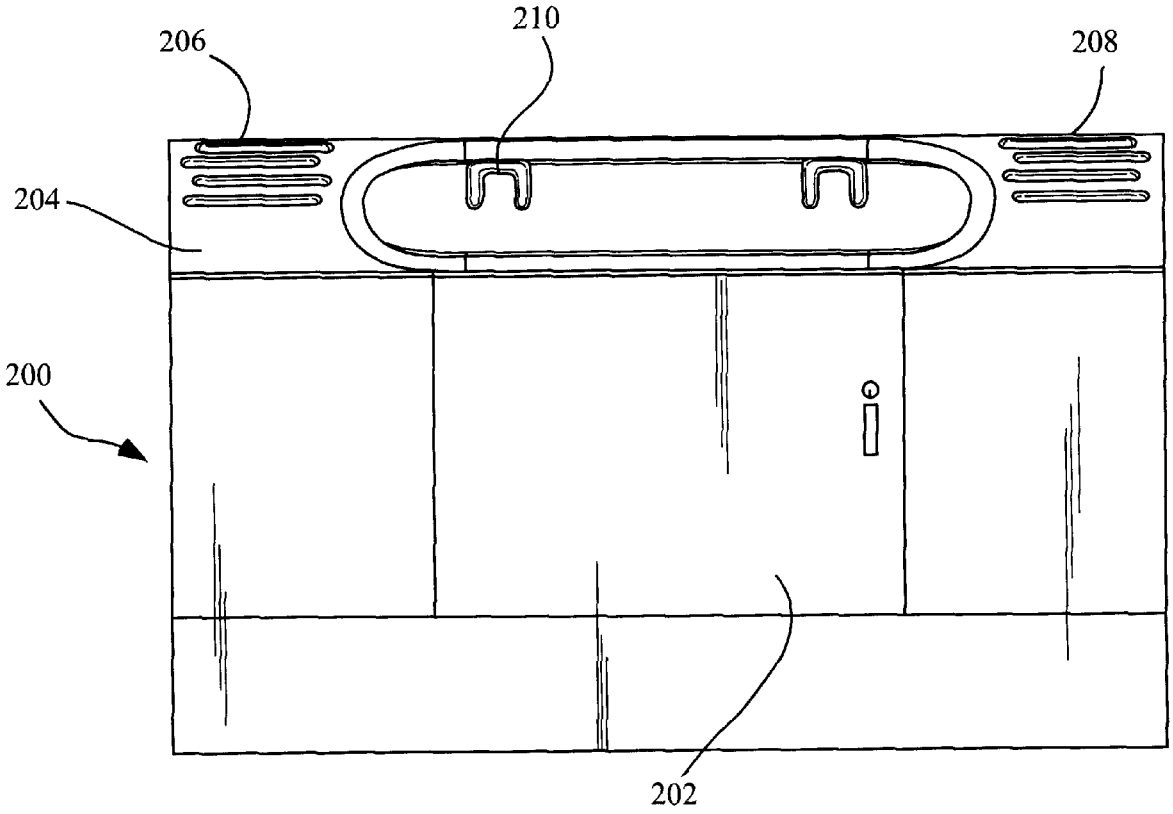
FIG. 2 is a front view of a base in accordance with the present invention.

FIG. 2 shows a front view of a base cabinet having one preferred embodiment of the present invention. Typically, base cabinet 200 has a front panel that incorporates door 202. Door 202 further incorporates a built-in footrest 204. Footrest 204 is a single unit, running across the top of base cabinet 200. Providing a footrest at this angle and height is entirely new. Footrest 204 further has ribs 206 and 208 molded into it, with a preferred embodiment having the rib area make from a substantially non-slippery and cushioning material such as rubber or equivalent synthetics. This makes it especially easy for a player to locate their feet on the ribbed area, then shift their body around enabling new positions available to the player than were not previously available. Note that the ribs are a preferred embodiment, but not required, as some casinos may prefer a different stylistic cue in the same location (perhaps the casino's logo molded into the top surface). Molded-in hangers 210 provide a place for players to hang pocket books and similar items.

Note that FIG. 2 illustrated the footrest as one unit with the base cabinet. Another embodiment of the present invention provides the molded footrest unit as a separately available footrest assembly from the base cabinet, so that current base cabinets could be retrofitted with the footrest.

Figure 3:
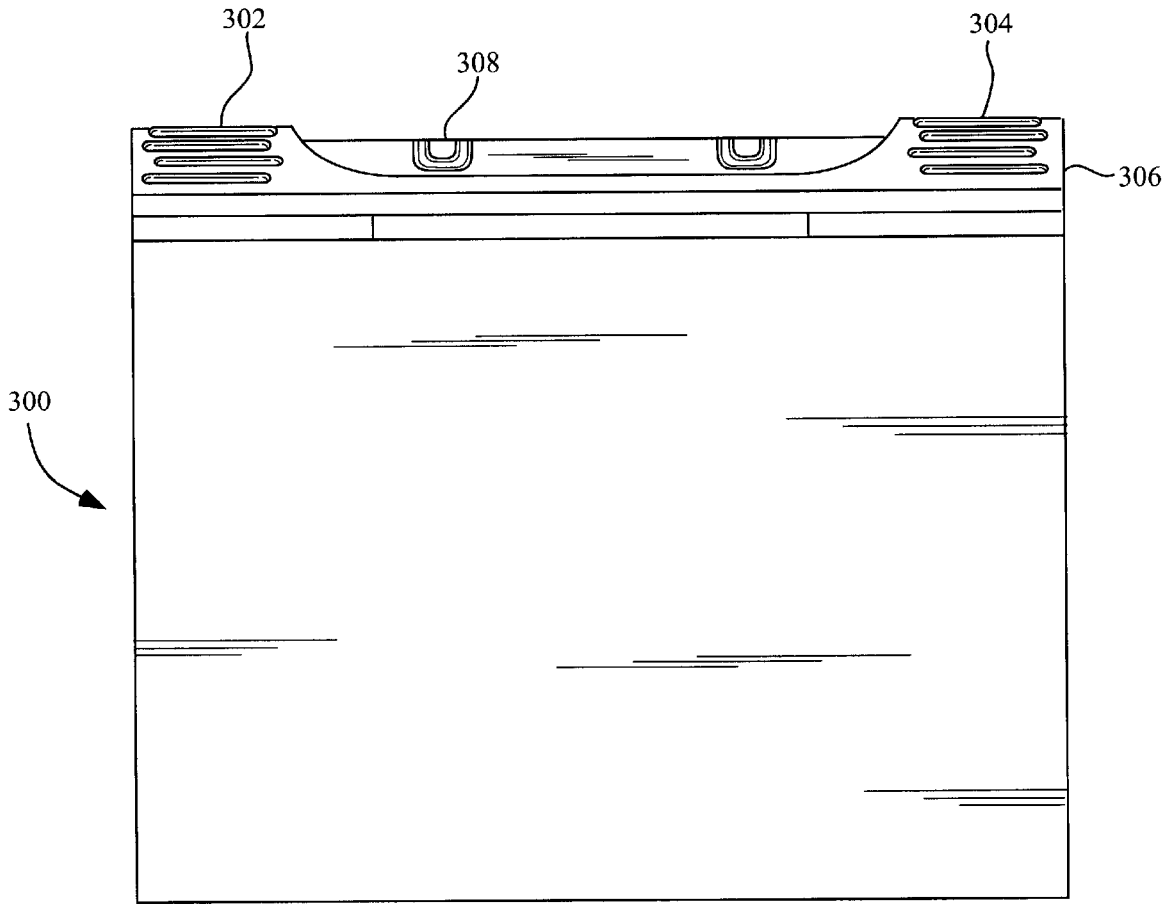
FIG. 3 is a top view of a base in accordance with the present invention.
Figure 4:
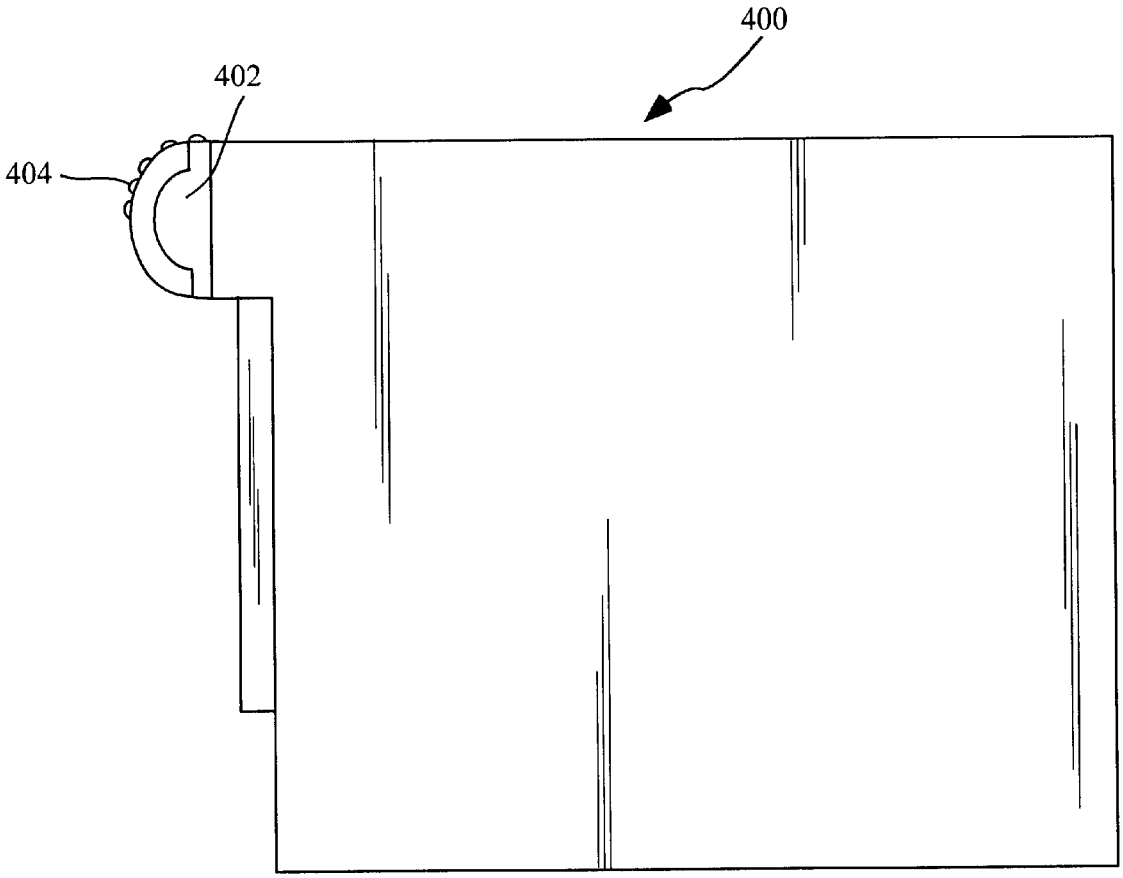
FIG. 4 is a side view of a base in accordance with the present invention.

FIG. 3 is a top view of a base cabinet 300. Footrest 306 has two ribbed footresting or footrest areas 302 and 304. Further shown is a personal accessory hook 308. FIG. 4 shows a base cabinet with footrest 402 from a side perspective. This shows the overall shape of the footrest area in a preferred embodiment; a half-round side section. Ribs 404 are for locating feet, but are optional.

Figure 5:
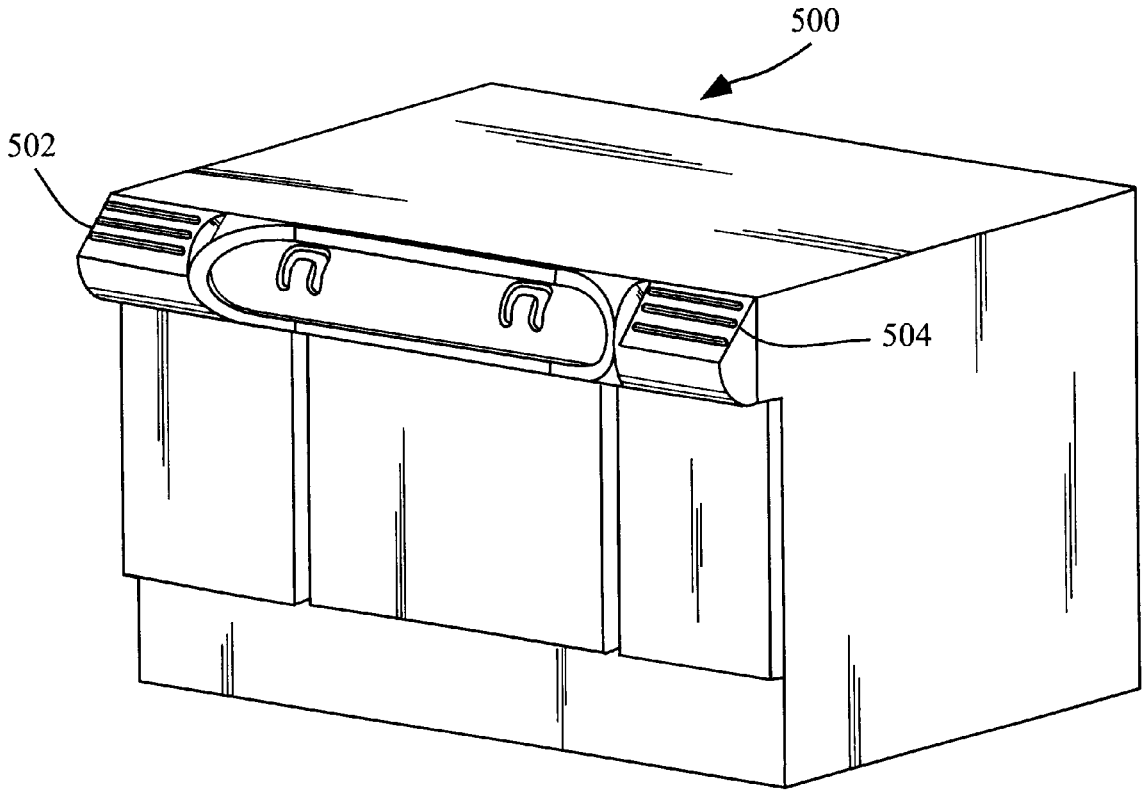
FIG. 5 is a perspective view of a base in accordance with the present invention.
Figure 6:
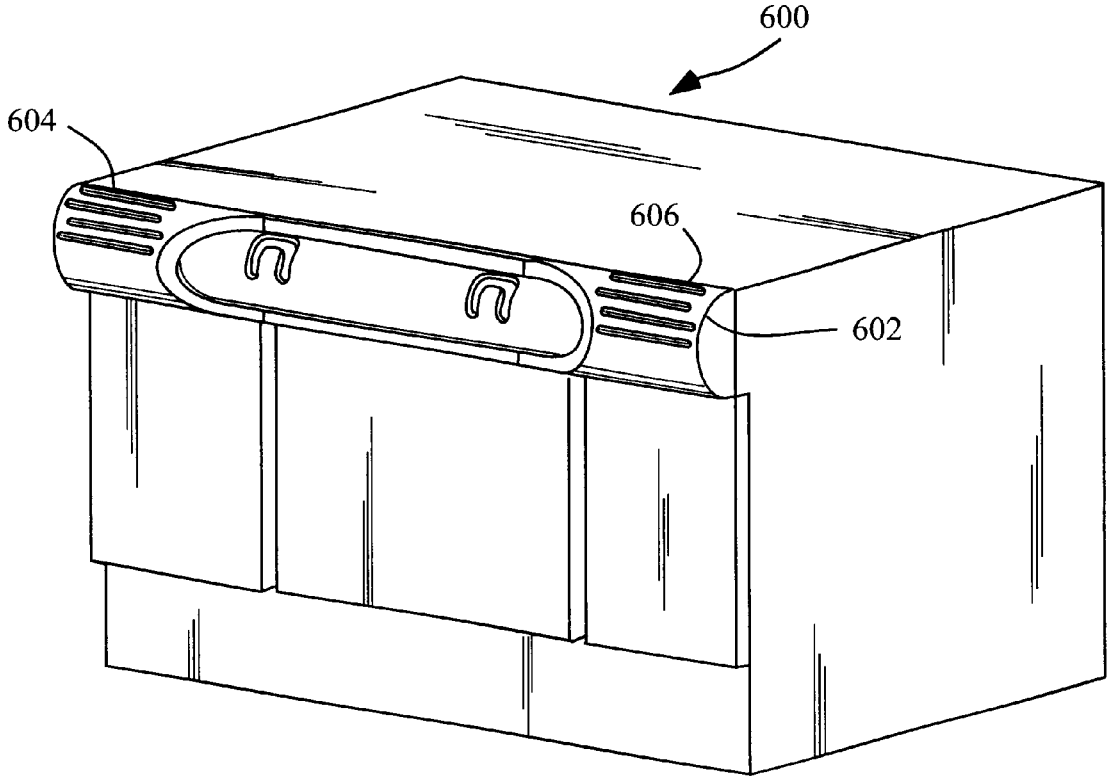
FIG. 6 is a perspective view of another base in accordance with the present invention.

FIGS. 5 and 6 show perspective views of base cabinets having footrests according to the present invention. FIG. 5 shows footrest areas 502 and 504 having flattened areas with ribs for a foot resting area (overall having a wedge shape), while FIG. 6 shows footrest 602 having the previously described half-round shapes for foot resting areas 604 and 606.

Figure 7:
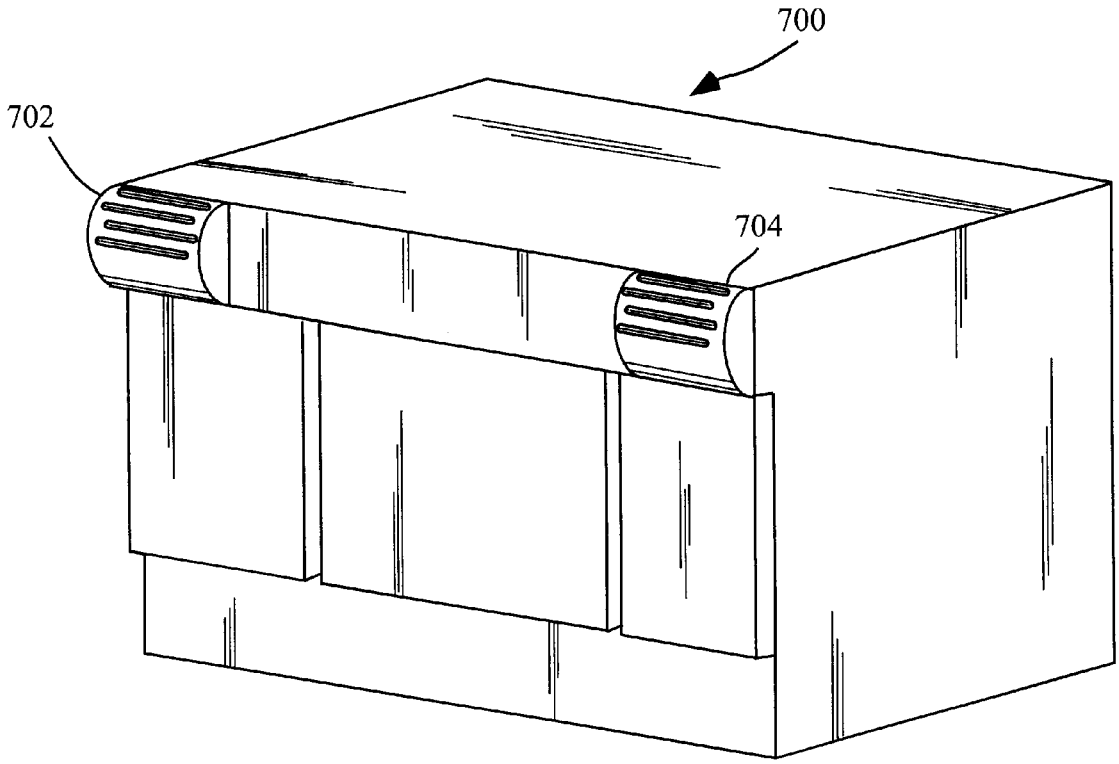
FIG. 7 is a perspective view of a further base in accordance with the present invention.
Figure 8:
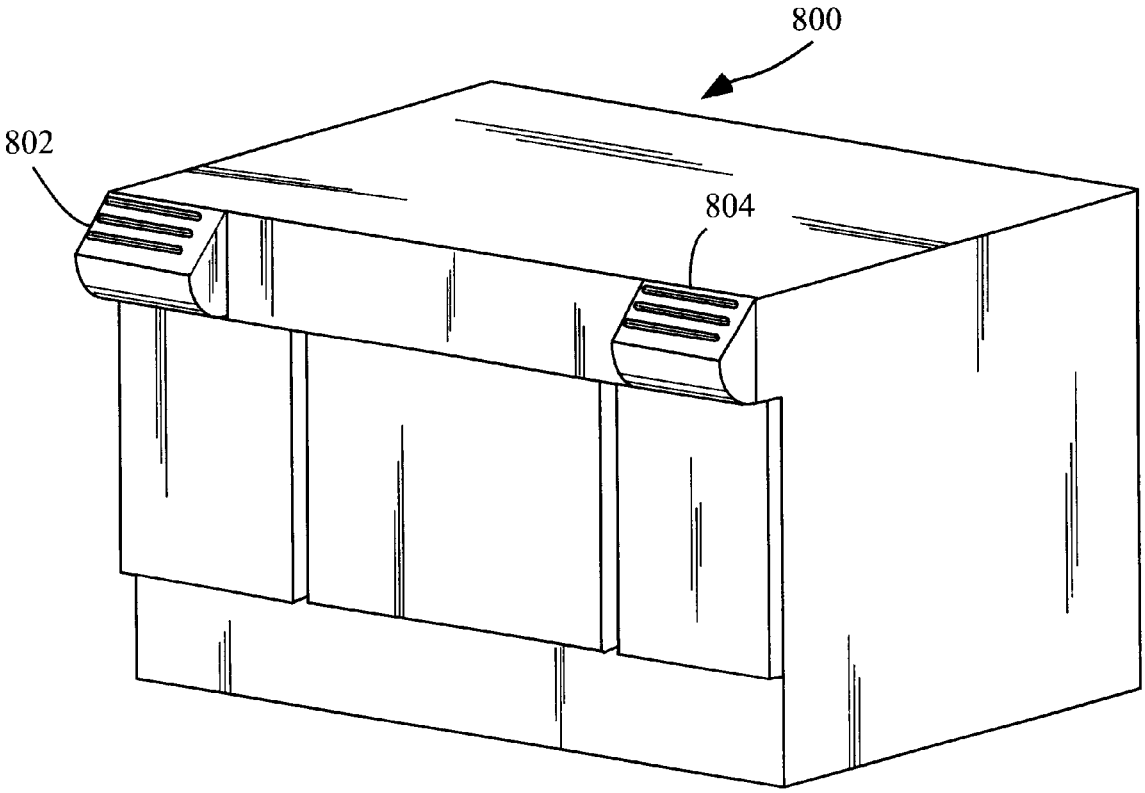
FIG. 8 is a perspective view of a further embodiment of a base in accordance with the present invention.

FIG. 7 shows a base cabinet 700 with footrests 702 and 704. These footrests are separate from each other on the base cabinet, not having a central connecting portion. They are half round in shape with ribbed areas for placing feet. FIG. 8 shows a base cabinet 800 with two individual footrests as in FIG. 700, but footrest areas 802 and 804 are substantially planar, providing a more downwardly angled foot resting area than that shown in FIG. 700. The individual footrests are thus substantially wedge shaped. The amount of downward angling may be changed (molded in) as requested by any particular casino. In addition, other shapes of foot rest areas can be provided as desired by the establishments purchasing the footrests or footrest and base cabinet units, and are fully contemplated as being within the inventive scope of the present invention.

Figure 9:
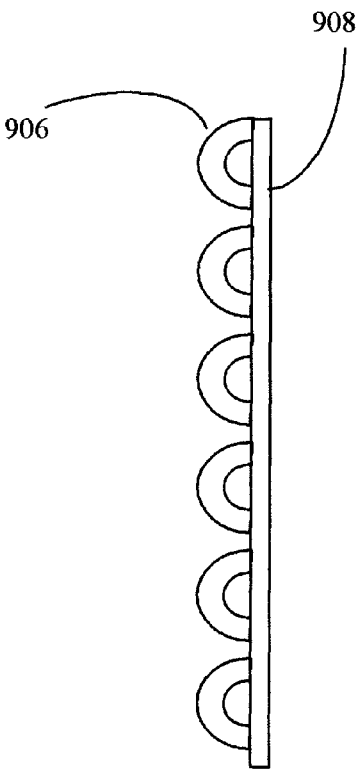
FIG. 9 is an illustration of a further embodiment of a base in accordance with the present invention.
Figure 9:
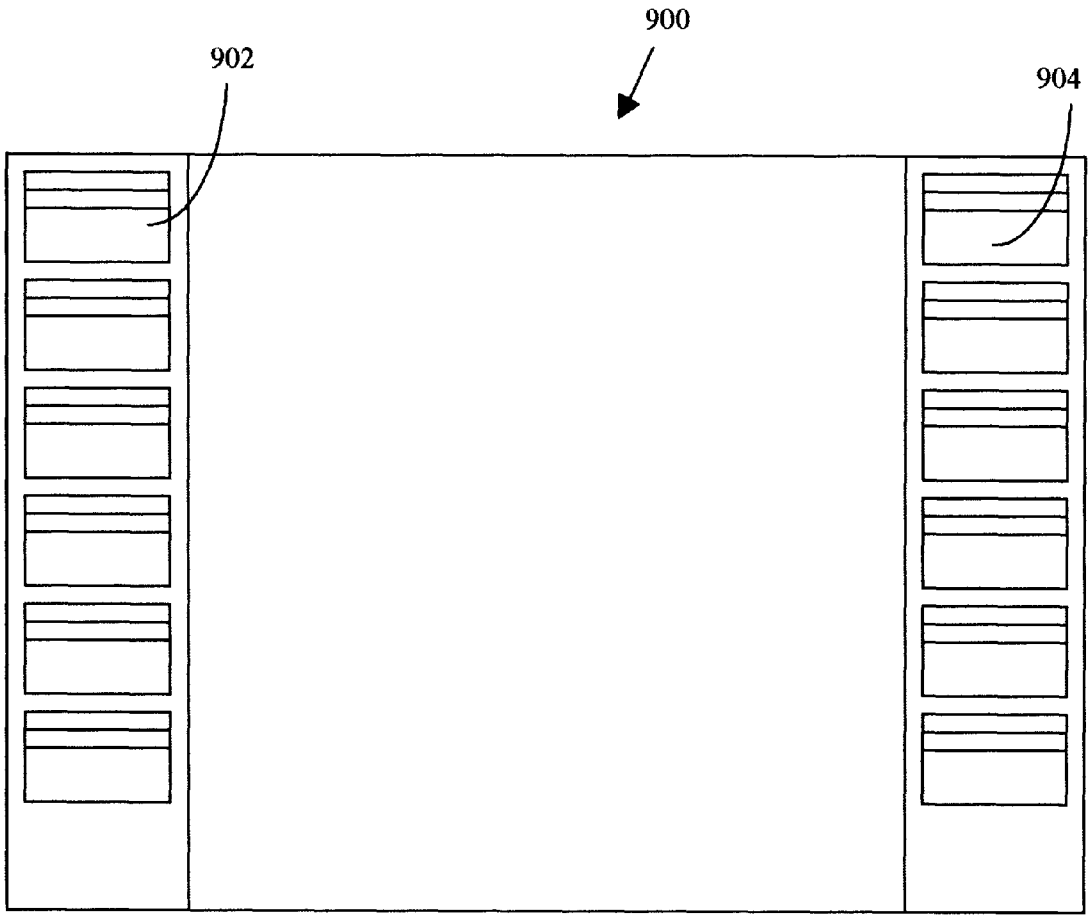

FIG. 9 shows another embodiment of footrests according to the present invention. Base cabinet 900 has more than one (illustrated are 6) of the individual style footrests described in FIG. 7 arranged in a vertical column along each of its outer edges. This provides a very large number of footrest locations for a player, and further allows the player to place each foot at a different level. This provides even more ways for a player to reposition themselves as they continue to play the gaming machine. The plurality of footrests shown on base cabinet 900 could be attached individually, or they could be attached to a backing plate 908, where the backing plate has attached to it any number of footrests 906 as is desired. Then, the backing plate is attached to a base cabinet or game machine cabinet. Further, the actual shape of the footrests may vary as discussed above.

FIGS. 2 through 9 have shown preferred embodiments of the present invention where footresting or footrest areas reach to the top of the base cabinet. Note that where patrons of a casino playing games of chance, or other games, may place their feet need not be at the top most portion of the footrest itself, even though the footrest enables the use of a footresting or footrest area at or nearly level with the top of the base cabinet. Further, as with the multi-positional stepped footrest shown in FIG. 9, there may any number of places a patron may place there feet in addition to placing their feet at or near the top of the base cabinet. Enabling the use of a footrest at the top of the base cabinet by providing at least one footresting location or area at a physically higher location than previously known, is a unique property of the present invention. For the purposes of this disclosure, this is called a high-mount footrest. It includes the embodiments described below as well as the embodiments already described.

As used in this disclosure, a foot rest that is "substantially close" to the top of the base cabinet means the availability of a footresting area (in use or not by a patron) that is attached in some manner to the front of the base cabinet, is further from the floor than the average footrest bars or footrest boards, and is as close to reaching the height of the top of the base cabinet as the cabinet and game machine combination reasonably allow, taking into account trim and general physical fitment issues (i.e., may be required to be some number of inches below the top surface of the base cabinet, depending on the base cabinet trim parts, gaming machine overhang, etc.). This definition further includes the concept of providing a footresting area as close to the top of the base cabinet as such issues allow, thus providing the highest reasonably possible footresting area for each base cabinet.

Figure 10:
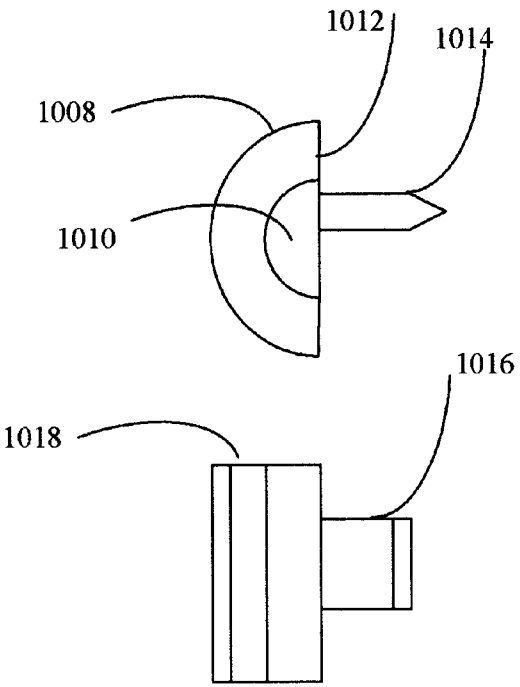
FIG. 10 is an illustration of adjustable footrests in a base in accordance with the present invention.
Figure 10:
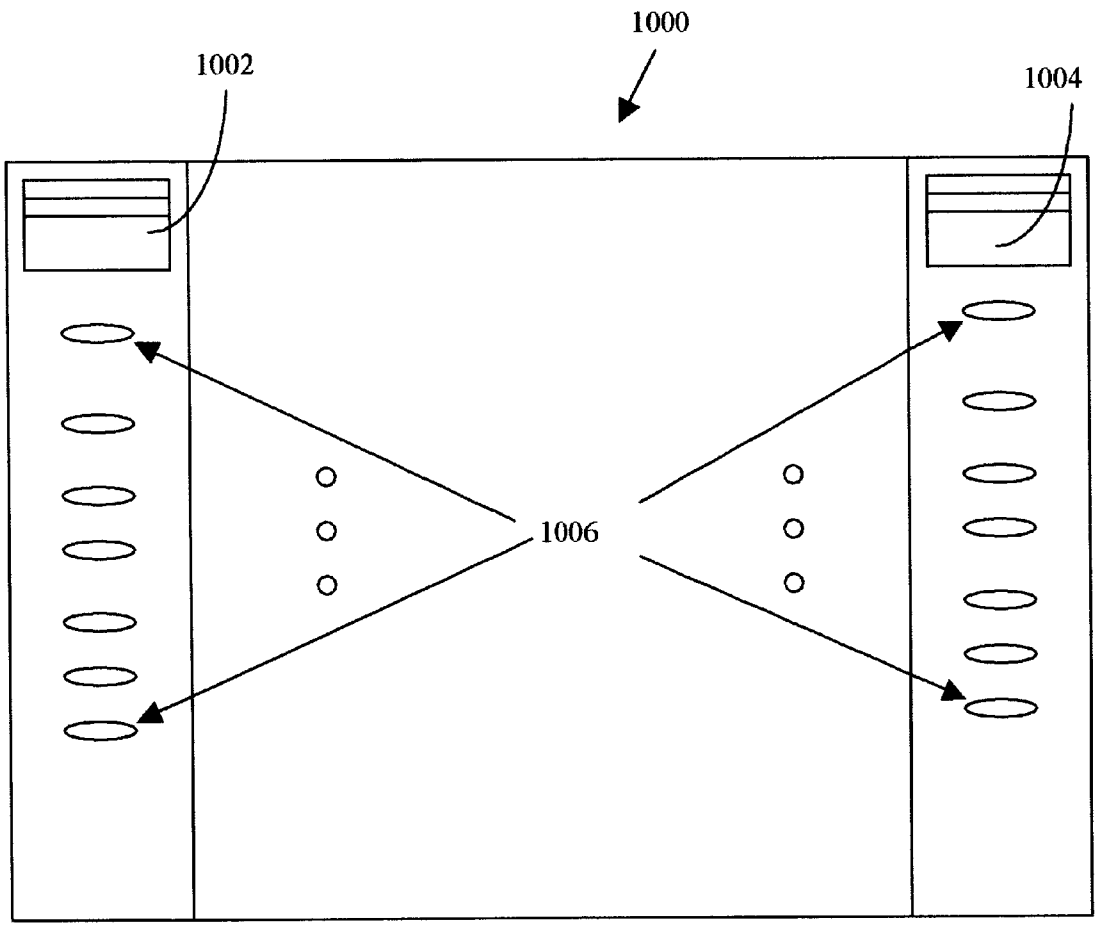

FIG. 10 shows one embodiment of adjustable footrests. Base cabinet 1000 has a plurality of receiving slots indicated generally by 1006. The slots are substantially rectangular in shape, with the very outermost edges flayed outwards to make fitting the pins into the slots easier, resulting in a more oblong external shape. The slots further have a lip or layer of material on the inside of the slot, which acts to keep the footrests in place. Such a gasket, lip, or o-ring will protrude slightly into the receiving slots to provide a snug fit for the pins (not shown). Footrests 1002 and 1004 look like the footrests previously described. Instead of being fixedly attached, however, they are adjustable.

Footrests 1012 and 1018 show what one embodiment of the locating pins look like. Footrest 1012 is a side view of one embodiment, having at least an outer layer or surface portion 1008 that is of a material suitable for a footrest (hard rubber, plastic, soft rubber, resilient plastic, etc.). Inner portion 1010 must be hard enough to support a foot and to provide a rigid attachment for pin 1014. In a preferred embodiment, inner portion 101 will be metal (steel) with a layer of footrest material 1008 bonded to it. Pin 1014 would then be permanently attached, preferably welded, to inner portion 1010. As can be seen by looking at footrest 1018, where pin 1016 represents a top view of pin 1014, the pin structure is substantially rectangular, presenting a wide surface area to the direction of the primary forces it will be subject to. As will be readily apparent to one of ordinary skill in this art and with the benefit of the present disclosure, pins shown as 1014 and 1016 together with receptacles 1006 could be varied in implementation while providing the same functionality—for example, two round pins could used instead of one rectangular, flat pin. All such variations are within the inventive scope of the present invention.

Figure 11:
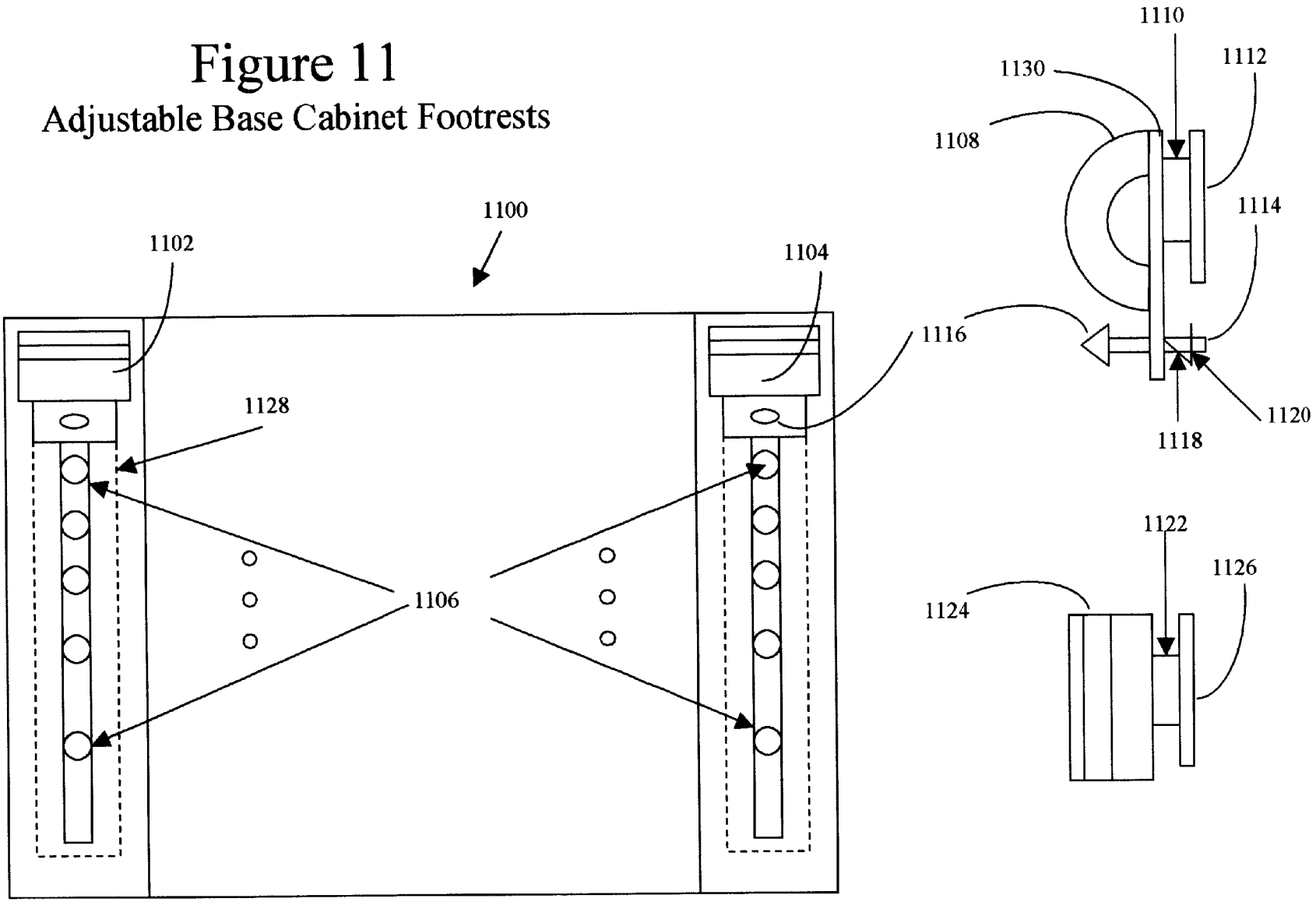
FIG. 11 is an illustration of a further embodiment of adjustable footrests in a base in accordance with the present invention.

FIG. 11 shows another embodiment of movable footrests. Base cabinet 100 has two footrests 1102 and 1104. Each footrest is slideable within an elongated substantially rectangular slot or guide 1128 having footrest stop holes or receptacles 1106. An illustration of a footrest 1108 that will work in the guide and provide a stopping means is shown in side view. The footrest portion is fixedly attached to a base 1130, the base being a strong and stiff material such as sheet steel or sheet plastic. Attached to the base is a necked portion 1110 that is designed to fit slideably and snugly into guide 1128. Attached to the neck is a back plate 1112 which together with base plate 1130 keeps necked portion 1110 inside the guide. Base plate 1130 further has a spring loaded locating pin assembly 1116. Pin assembly 1116 has a knobbed portion for the player or user to pull on, which compresses spring 1118, which is trapped between base plate 1130 and spring keeper washer 1120. Spring keeper washer 1120 is attached fixedly to the pin. End 1114 of pin assembly 1116 recedes from one of holes 1106 when the pin assembly is pulled by a player or user, the player or user then slides the footrest assembly to a position of choice, then releases pin assembly 1116. End portion 1114 will then, due to spring 1118, be pushed into one of holes or receptacles 1106. If a hole is not immediately under end portion 1114, the entire footrest assembly will slide downwards until the next hole is reached, at which point the end portion will slide into a hole, securing the footrest for use by the player or user.

A top view of a footrest for use in this embodiment is shown as footrest 1124. Shown in particular is back plate 1126 (corresponding to back plate 1112) and necked portion 1122. This view shows the side edges of the necked portion that will slide within the guides on a base cabinet or game cabinet (they are the top and bottom edges of the top view).

Figure 12:
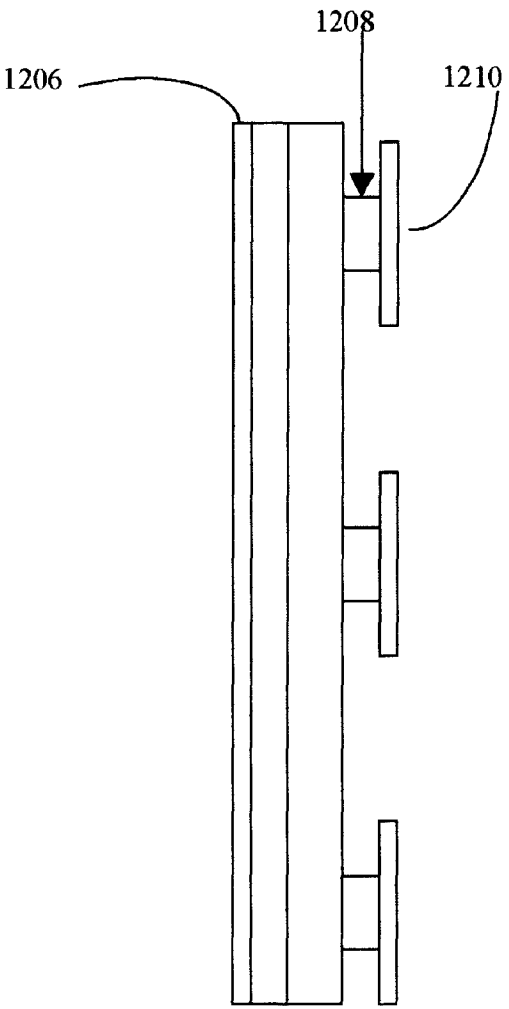
FIG. 12 is an illustration of yet another embodiment of adjustable footrests in a base in accordance with the present invention.
Figure 12:
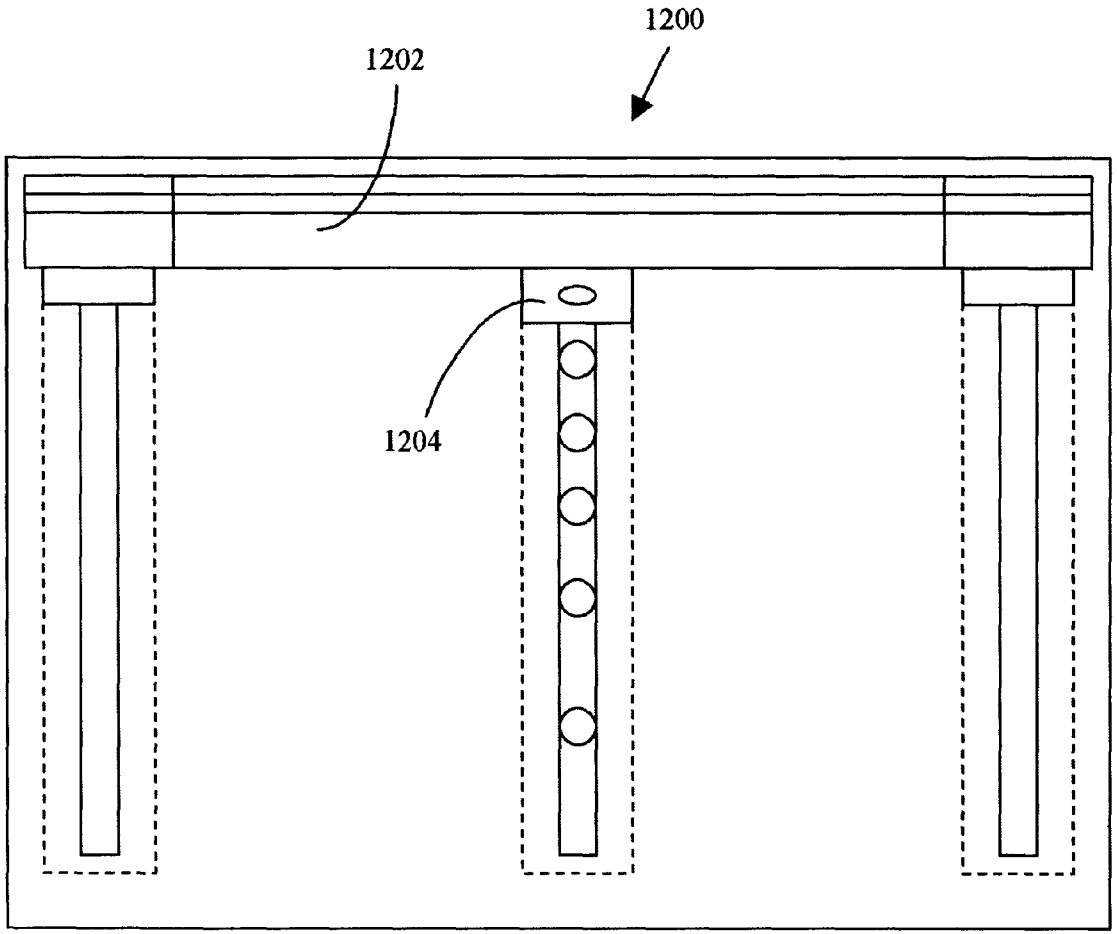

FIG. 12 shows a unified footrest assembly, using a substantially similar adjustment mechanism described in FIG. 11. Footrest 1202 is a single unit across the front of base cabinet 1200. There are three guides, with only the center guide having locating holes and a corresponding locating pin assembly, the locating pin assembly being mounted in base plate 1204. A top view of a unified footrest assembly is shown as footrest assembly 1206, with three base plate assemblies 1210 and necked portions 1208. The center pin assembly is hidden in the top view, being below the center necked portion.

Figure 13:
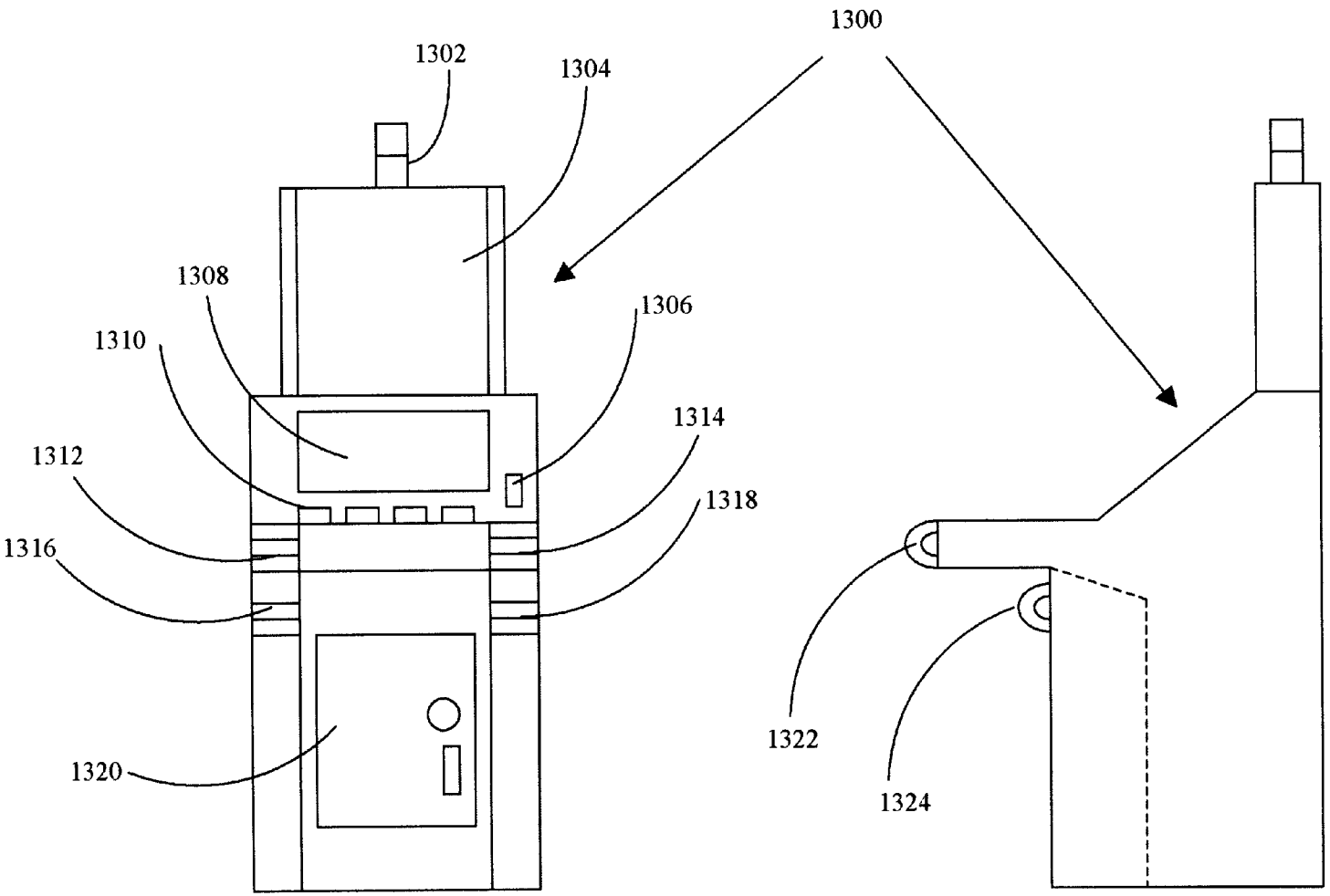
FIG. 13 is an illustration a gaming machine with built-in cabinet and footrests in accordance with the present invention.

FIG. 13 illustrates a gaming machine with a built-in game cabinet base comprising a single game cabinet unit, 1300, in accordance with the present invention. The outline is that of a slant top gaming machine, but is to be understood as representing any casino type gaming machine having a built-in lower cabinet, therefore not needing a base cabinet when installed on a casino floor. The lower cabinet part of a gaming machine is considered as that part below the game display and below the active game I/O devices (typically buttons). Thus, the lower portion of the gaming cabinet has a "height" similar to that of a base cabinet, only with single unit cabinetry the height is defined by the bottom of the player playing area, including the game display area and the active I/O device area (does not mean any I/O devices that may be mounted inside the lower cabinet area). With a typical slant top machine, the external shape makes it quite clear what the height of the lower portion or area is—it is under the cabinet bolster area, where the external cabinetry makes an inward turn, and where the instep area of the cabinetry starts and the lower portion door is located.

Note that upon occasion, some additional player I/O may be located in the lower cabinet area. This player I/O is not for active game play, being too low. Such additional I/O devices are for EFT transfers, a bill receptor, or other ancillary gaming activity, and are not what is meant by active game play I/O, and are considered to be within the lower cabinetry area.

Typical gaming machine components include a candle 1302, promotional area 1304, active game play and game display area 1308, bill acceptor or magnetic strip card reader 1306, and player I/O interfaces 1310. Such gaming machines typically have space in the lower portion of the cabinet accessible through a lockable door 1320.

Gaming cabinet 1300 further has two sets of footrests according to the present invention. Footrests 1312 and 1314 are individual, fixed footrests similar to those described above for base cabinets. These would typically be added to exterior of a cabinet not having a bolster, or would replace a bolster. 1322 shows a fixed footrest from a side view of a gaming machine. This embodiment is a replacement of an existing bolster, especially useful for upgrading existing gaming machine cabinetry.

Footrests 1316 and 1318 are individual adjustable footrests, where mechanisms such as those shown in FIGS. 10 or 11 may be used (not shown). Footrest 1324 is one embodiment of the lower footrests on a gaming machine, in side view. Any of these footrests mounted in the lower cabinetry area may be fixed, multi-positional, or adjustable.

Note that many variations may be used while remaining within the inventive scope of the present invention. For example, instead of having a recessed portion of the two outer edges of a gaming cabinet with a separate set of footrests, a gaming cabinet could be constructed having a single straight edge from the end of the playing surface to the floor. Then, either a set of fixed footrests, a set of adjustable footrests, or a set of fixed, stepped footrests could be used along each edge. Further a single, unified adjustable footrest could be provided, where the unified footrest assembly would be similar to that shown in FIG. 12, but differing in that there would be no center guide, no center sliding portion on the footrest assembly, and the locating pin assemblies would be mounted on each of the two endplates, workable through a centrally mounted pull-pin connected to the pin assemblies at each side via steel or nylon pull-cords. This would work in single-unit gaming cabinetry still having a recessed center portion for the lower cabinet, providing a free-standing center portion.

In addition to all the variations on complete base cabinet assemblies and gaming machine cabinet assemblies, the present invention further discloses and contemplates providing the disclosed footrest assemblies for preexisting base cabinets and gaming machine cabinets. This includes all embodiments, both fixed and adjustable. This allows casinos, bingo halls, and similar establishments to upgrade their existing cabinetry with a minimum of cost.

Figure 14:
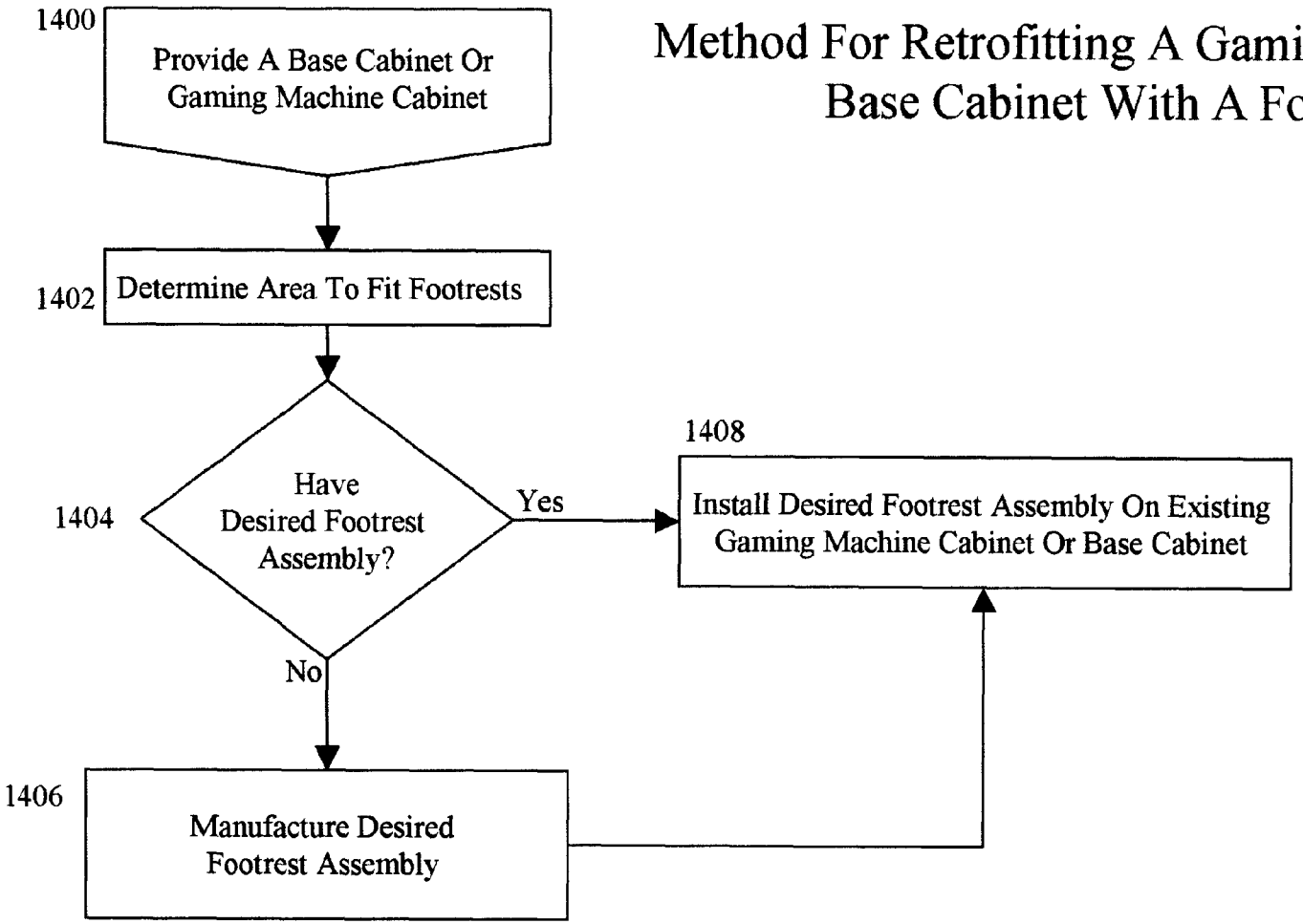
FIG. 14 is a flow diagram illustrating fitment of footrests according to the present invention preexisting gaming cabinetry.

FIG. 14 illustrates a method for upgrading an existing gaming machine or game machine base cabinet with the footrests of the present invention. Starting at block 1400, at least one preexisting gaming machine base cabinet or gaming machine cabinet is chosen for an upgrade. Block 1400 is left and block 1402 entered.

The actions corresponding to block 1402 are to choose the area on the preexisting cabinetry (including both or either base cabinets of gaming machine having a built in lower cabinet portion) where the footrest or footrests are to be located (note—it is entirely reasonable to choose to install only a footrest on one side the cabinet, either fixed or adjustable, depending on the needs and space available in a particular location). Clearly the easiest and least expensive to install are the fixed position, individual footrests. These may be mounted directly to existing cabinetry with a minimum of work, usually only requiring a fastening means. The fastening means may include industrial adhesives, nails, screws, rivets, or any other fastening methods suitable for the cabinetry. To provide multiple footrest locations, the next easiest are the fixed, stepped footrest assemblies. Finally, the adjustable footrests would require the most work. However, it should be noted that the slideable footrests with channels would typically be easy to install. The footrest assembly would come with the footrest and locator pin assemblies, the front portion of the guide, and a rear plate to install first, forming the back of the guide (rear plate not illustrated). The rear plate would be substantially similar in size and shape as the front guide portion, and further would have pre-drilled holes for the locator pin(s). This would make installation only slightly harder than the fixed footrest assemblies.

After determining the footrest assembly or assemblies to use, and their quantities, box 1402 is left and diamond 1404 entered. The actions corresponding to diamond 1404 are to determine if the desired footrest assemblies are on hand or in stock. If they are, the "YES" exit is taken to block 1408. The actions corresponding to block 1408 are to install the desired footrest assemblies on the designated cabinetry. If, at diamond 1404, it is determined that the desired footrest assemblies are not on hand or in stock, they will be manufactured to suit, existing footrest assemblies modified, or, in extreme cases, a determination made that they cannot be supplied (this branch not illustrated).

The cannot-be-supplied case could occur if a casino requested, for example, to upgrade a gaming machine with built in lower cabinetry having insufficient strength in its side members (this would typically never happen with a base cabinet). In such a case the cabinetry itself would have to replaced or upgraded. This will be a rare occurrence, so is not illustrated.

Continuing on, from diamond 1404 block 1406 comprises providing the needed footrests for the upgrade. After providing the needed footrest assemblies, block 1406 is left and block 1408 entered, where, as previously discussed, the footrest assemblies are mounted on the existing cabinetry.

Figure 15:
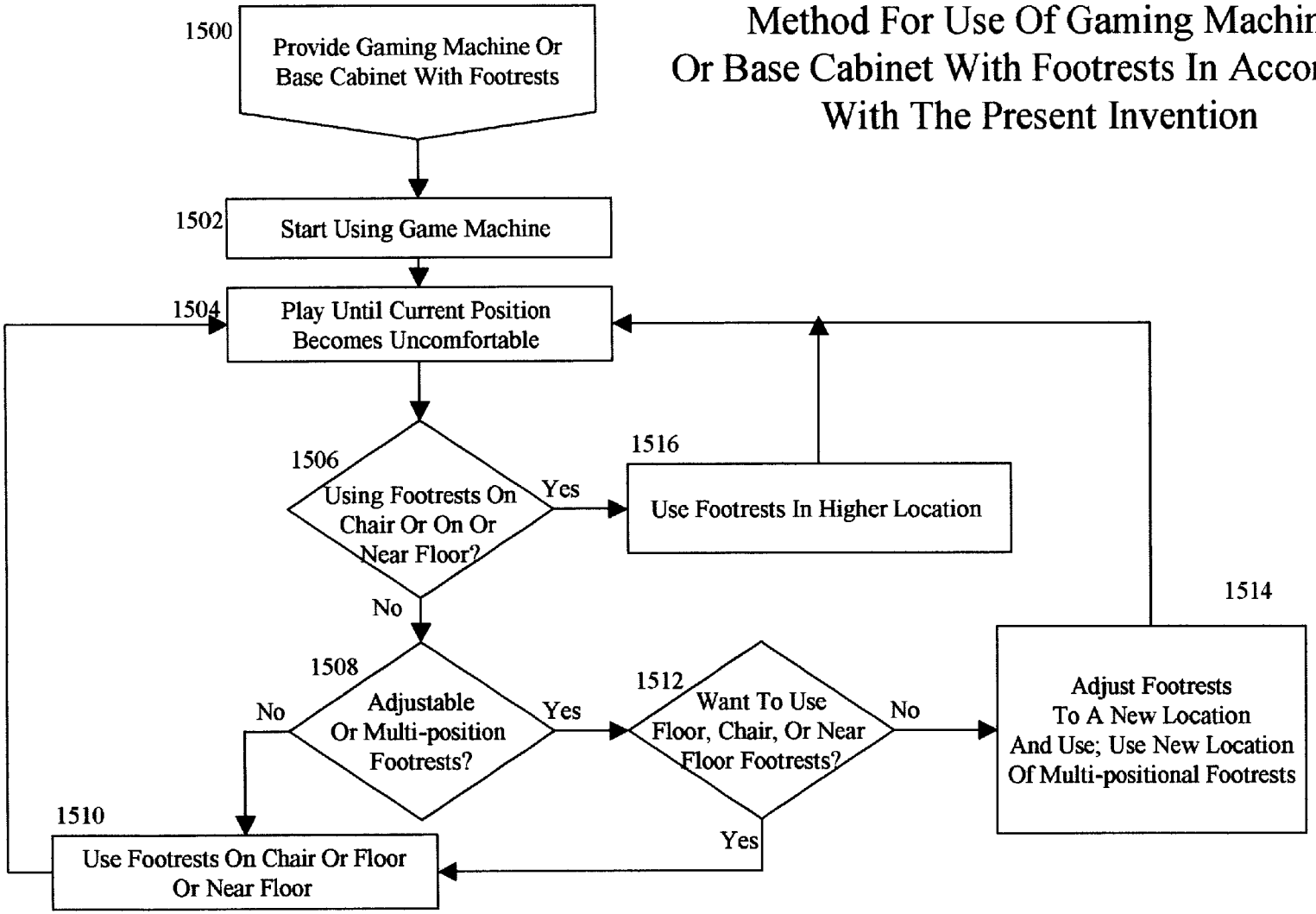
FIG. 15 is a flow diagram showing use of gaming cabinetry according to the present invention.

FIG. 15 illustrates a method for using a gaming machine having the new footrests according to the present invention. Starting at block 1500, at least one gaming machine having cabinetry with footrests according to the present invention is provided. Leaving block 1500 for block 1502, a player or user starts using the gaming machine by playing the game therein. Leaving block 1502 for block 1504, the game remains in used until the player wishes to make use of a different sitting position. Instead of leaving the game as would have been the case while using games having prior art cabinetry, the player now chooses to alter their position using the footrests according to the present invention.

Leaving block 1504 for diamond 1506, it is determined if the player currently has their feet on the floor, on footrests in the chair, or perhaps a prior art footrest near the floor (a footrest bar or floor footrest). If so, the "YES" exit is taken to block 1516, where the actions comprise using the footrests provided in accordance with the present invention. Note that if the footrests are adjustable, part of this step is the player adjusting them, if they wish, before putting their feet on them.

Block 1516 is left and block 1504 re-entered, where play continues until the player wants to change position again.

Returning to diamond 1506, if the player is already using footrests according to the present invention, the "NO" exit is taken to diamond 1508. In diamond 1508, it is determined if the gaming cabinetry has either adjustable or multi-positional (FIG. 9) footrests or not. If the answer is "NO", then the "NO" exit is taken to block 1510, where the player makes use of the prior art footrests or the floor, then proceeds to block 1504 to continue playing until a change in position is desired.

If at diamond 1508 the answer is "YES", the "YES" exit is taken to block 1512, where the player makes a choice as to readjusting their position using the footrests according to the present invention, or using the floor or prior art footrests. If a player chooses to use the prior art footrests, then the "YES" exit is taken to block 1510. The actions corresponding to block 1510 are to put feet on the prior art footrest or floor, then continue to block 1504. In block 1504 game play continues until the next position change is needed.

Returning to diamond 1512, if the "NO" exit is taken, block 1514 is entered. The actions corresponding to block 1514 are to one of: use a new position of the multi-positional fixed footrests; or, adjust the adjustable footrests to a new position, and then rest at least one foot on a readjusted footrest. Either action results in the player having attained a new position, resulting in regained comfort and the ability to continue game play. Block 1514 is left and block 1504 re-entered, where game play continues until a new position is required.

Note that the above method of use shows the new ways that are now available for deriving continued comfort during extended game play. Further, it should be noted that the amount of comfort derived is higher than may at first obvious. That is due to the fact that the footrests of the present invention enable significant positional shifts while still remaining seated. Using the multi-positional, adjustable, or bolster-area footrests doesn't just shift your seating position a little, as with the difference between a footrest bar (footbar) and the floor—using these new footrests shifts the position of your entire body. This provides more relief and more possibilities for body position change than was previously possible.

Although the description above contains certain specificity, the described embodiments should not be construed indicating the scope of the invention; the descriptions given are providing an illustration of certain preferred embodiments of the invention. The scope of this invention is determined by the appended claims and their legal equivalents.

What is claimed is:

1. A footrest and base cabinet assembly, the assembly adapted for use in a gaming environment, the assembly comprising:

a base cabinet having a front, a first side, a second side, and a top;

two individual footrests, each connected to said front at substantially opposite sides, configured such that said two individual footrests may enable a footrest area at a height further comprising one of: at the same height as said top; or, at a height substantially close to said top.

2. The assembly of claim 1 where said being connected further comprises each footrest being individually adjustably connected and having a first and a second plurality of footrest and a first and a second individual footrest, where said first plurality of footrest receptacles are located substantially vertically from each other, and where said second plurality of footrest receptacles are located substantially vertically from one another, and where said first plurality of footrest receptacles are configured to be usable with said first individual footrest, and said second plurality of footrest receptacles are configured to be usable with said second individual footrest, and where said first individual footrest further comprises at least one securing mechanism suitable for use in any of said first plurality of footrest receptacles, and said second individual footrest further comprises at least one securing mechanism suitable for use in any of said second plurality of footrest receptacles.

3. A footrest and gaming machine cabinet assembly, the assembly adapted to house at least one game for use in a gaming environment, the assembly comprising:

an upper area, adapted to house at least one game display;

a lower area, said lower area having a front, a first side, a second side, a back, and a height, said height being substantially close to, and below, said upper area, and further where said lower and upper areas form a single cabinetry unit;

two individual footrests, each connected to said front at substantially opposite sides, configured such that said footrests may enable a footrest area at a height further comprising one of: being located at said height; or, being located substantially close to said height.

4. The assembly of claim 3 where said being connected further comprises each footrest being individually adjustably connected and having a first and a second plurality of footrest receptacles and a first and a second individual footrest, where said first plurality of footrest receptacles are located substantially vertically from each other, and where said second plurality of footrest receptacles are located substantially vertically from each other, and where said first plurality of footrest receptacles are configured to be usable with said first individual footrest and said second plurality of footrest receptacles are is configured to be used with said second individual footrest, and where said first individual footrest further comprises at least one securing mechanism suitable for use in any of said first plurality of footrest receptacles, and said second individual footrest further comprises at least one securing mechanism suitable for use in any of said second plurality of footrest receptacles.

* * * * *

UNITED STATES PATENT AND TRADEMARK OFFICE

CERTIFICATE OF CORRECTION

PATENT NO. : 6,637,844 B1
DATED : October 28, 2003
INVENTOR(S) : Robert A. Luciano, Jr. et al.

It is certified that error appears in the above-identified patent and that said Letters Patent is hereby corrected as shown below:

Column 10,
Line 4, should read:
-- footrest receptacles and a first and second individual footrest, where --
Line 43, should read:
-- footrest receptacles are configured to be used with said --

Signed and Sealed this

Thirteenth Day of April, 2004

JON W. DUDAS
*Acting Director of the United States Patent and Trademark Office*